US009239527B2

(12) United States Patent
Taguchi et al.

(10) Patent No.: US 9,239,527 B2
(45) Date of Patent: Jan. 19, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Tetsuya Taguchi, Kanagawa (JP); Shinya Sakamoto, Kanagawa (JP); Kosaku Yoshimura, Kanagawa (JP); Satoshi Yoshida, Kanagawa (JP); Shinya Nakashima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 30 days.

(21) Appl. No.: 14/190,513

(22) Filed: Feb. 26, 2014

(65) Prior Publication Data

US 2015/0044601 A1 Feb. 12, 2015

(30) Foreign Application Priority Data

Aug. 8, 2013 (JP) ..... 2013-165491

(51) Int. Cl.
*G03G 9/087* (2006.01)
*G03G 9/08* (2006.01)

(52) U.S. Cl.
CPC ..... *G03G 9/0819* (2013.01); *G03G 9/0825* (2013.01); *G03G 9/0827* (2013.01); *G03G 9/08733* (2013.01); *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08711; G03G 9/08795; G03G 9/08797; G03G 9/08755; G03G 9/0819; G03G 9/0827; G03G 9/0821
See application file for complete search history.

(56) References Cited

U.S. PATENT DOCUMENTS

| | | | | |
|---|---|---|---|---|
| 4,533,614 | A * | 8/1985 | Fukumoto et al. | 430/124.3 |
| 6,221,548 | B1 * | 4/2001 | Shiba et al. | 430/114 |
| 6,319,646 | B1 * | 11/2001 | Suganuma | 430/111.4 |
| 2002/0037467 | A1 | 3/2002 | Watanabe et al. | |
| 2003/0210930 | A1 * | 11/2003 | Nakai et al. | 399/267 |
| 2003/0219670 | A1 * | 11/2003 | Sawada et al. | 430/109.4 |
| 2005/0025535 | A1 * | 2/2005 | Koichi et al. | 399/313 |
| 2005/0175924 | A1 * | 8/2005 | Hasegawa et al. | 430/200 |
| 2005/0287465 | A1 * | 12/2005 | Ohshima et al. | 430/124 |
| 2006/0032952 | A1 * | 2/2006 | Kawamoto et al. | 241/40 |
| 2009/0117486 | A1 * | 5/2009 | Watanabe et al. | 430/111.4 |

FOREIGN PATENT DOCUMENTS

| | | |
|---|---|---|
| JP | A-2001-255690 | 9/2001 |
| JP | A-2002-82488 | 3/2003 |
| JP | A-2009-9162 | 1/2009 |
| JP | A-2009-37255 | 2/2009 |
| JP | B2-4293017 | 7/2009 |
| JP | B2-4466393 | 5/2010 |
| JP | B2-4470594 | 6/2010 |
| JP | A-2011-28007 | 2/2011 |
| JP | A-2011-145321 | 7/2011 |
| JP | A-2013-57873 | 3/2013 |

* cited by examiner

*Primary Examiner* — Hoa V Le
(74) *Attorney, Agent, or Firm* — Oliff PLC

(57) ABSTRACT

An electrostatic charge image developing toner includes toner particles containing a binder resin containing a polyester resin forming a sea part and a vinyl resin forming an island part of a sea-island structure, a first release agent existing in the sea part in a domain state, and a second release agent existing in the island part in a domain state, wherein when a cross-sectional area of the second release agent is set to A1 and a cross-sectional area of the first release agent is set to B1 in a cross section of the toner particles, a relationship of $0.2 \leq A1/B1 \leq 0.8$ is satisfied.

19 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-165491 filed Aug. 8, 2013.

BACKGROUND

Technical Field

The present invention relates to electrostatic charge image developing toner, an electrostatic charge image developer, and a toner cartridge.

SUMMARY

According to an aspect of the invention, there is provided an electrostatic charge image developing toner including toner particles containing a binder resin containing a polyester resin forcing a sea part and a vinyl resin forming an island part of a sea-island structure, a first release agent existing in the sea part in a domain state, and a second release agent existing in the island part in a domain state, wherein when a cross-sectional area of the second release agent is set to A1 and a cross-sectional area of the first release agent is set to B1 in a cross section of the toner particles, a relationship of $0.2 \leq A1/B1 \leq 0.8$ is satisfied.

BRIEF DESCRIPTION OF THE DRAWINGS

Exemplary embodiments of the present invention will be described in detail based on the following figures, wherein.

DETAILED DESCRIPTION

Figure 1:
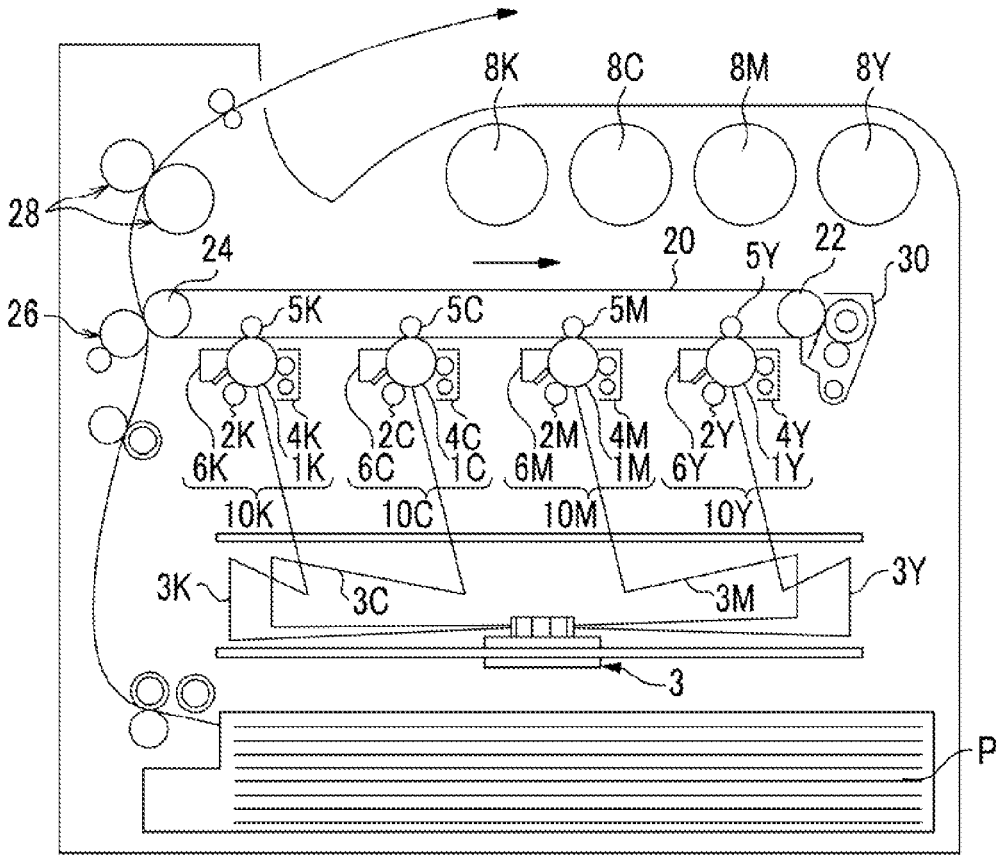
FIG. 1 is a schematic configuration diagram showing an example of an image forming apparatus according to an exemplary embodiment.

Hereinafter, exemplary embodiments which are examples of the invention will be described in detail.

Electrostatic Charge Image Developing Toner

Electrostatic charge image developing toner (hereinafter, simply referred to as "toner") according to the exemplary embodiment includes toner particles containing a binder resin containing a polyester resin forming a sea part and a vinyl resin forming an island part in a sea-island structure, a first release agent existing in the sea part in a domain state, and a second release agent existing in the island part in a domain state, in which, when a cross-sectional area of the second release agent is set to A1 and a cross-sectional area of the first release agent is set to B1 in a cross section of the toner particles, a relationship of $0.2 \leq A1/B1 \leq 0.8$ is satisfied.

According to the configuration, even when a half-tone image is formed on a recording medium having great concavity and convexity on a surface thereof with the toner according to the exemplary embodiment, image intensity of the half-tone image is improved.

The reason thereof is not clear but the following reason is considered.

In the half-tone image (for example, image having image density of 1% to 30% when image density of an image in which toner particles exist on one surface with no clearance is set to 100%), since a distance between toner particles on the recording medium is great compared to a solid image and the toner particles are in an independent state, the half-tone image is an image in which the toner particles melted at the time of fixing hardly come into contact with each other.

In a case of forming the half-tone image on a recording medium which is not subjected to a smoothing process (for example, coating process and calender process) of a surface thereof and has great concavity and convexity of a surface, since the convexity of the recording medium which is not subjected to the smoothing process (for example, coating process and calender process) of the surface thereof and has great concavity and convexity of the surface (hereinafter, referred to as "convexity on the recording medium") receives strong heat and pressure compared to the concavity on the recording medium, the binder resin of the melted toner particles permeates the convexity on the recording medium and an image having high image intensity is easily obtained, but since the concavity on the recording medium which is not subjected to the smoothing process (for example, coating process and calender process) of the surface thereof and has great concavity and convexity of the surface (hereinafter, referred to as "concavity on a recording medium") does not receive heat and pressure to a degree such chat the binder resin penetrates the concavity on the recording medium, an image having high image intensity is hardly obtained. Accordingly, when the recording medium is rubbed with a hand or a cloth or is rubbed by placing a sheet on the recording medium, some of the toner particles are moved to a fixing member in a state of being peeled off, and accordingly this is a reason for damage to or contamination of the image.

In contrast, if heat and pressure are sufficient for the binder resin of the melted toner particles to penetrate the concavity on the recording medium is applied, an image having high image intensity is easily obtained in the concavity on the recording medium, but since melt viscosity of the melted toner particles decreases and an inter-molecular cohesive force greatly decreases due to excessive heat and pressure applied to the convexity on the recording medium, it is considered that some of the toner particles may be moved to the fixing member and offset may easily occur. The offset toner is a cause for a contaminated image forming apparatus and paper jam, or is a cause for a dirty recording medium by moving again to the recording medium on a lower side of an image unit.

If the release agent is contained in the toner particles for suppressing the offset, the release agent exists at an interface between the toner particles and the fixing member at the time of fixing, and accordingly the offset to the fixing member is suppressed. Since the toner particles receive sufficient heat and pressure from the fixing member on the convexity on the recording medium which is not subjected to the smoothing process of the surface thereof and has great concavity and convexity of the surface (hereinafter, referred to as "convexity on the recording medium"), the melt viscosity of the binder resin decreases, the toner particles adhere to or penetrate the recording medium at the same time the release agent exists in the interface with the fixing member and accordingly the offset is suppressed and the image intensity increases. However, since the toner particles receive insufficient heat or pressure from the fixing member and are in a state with less deformation of the toner particles or melting of the binder resin in the concavity on the recording medium which is not subjected to the smoothing process of the surface thereof and has great concavity and convexity of the surface (hereinafter, referred to as "concavity on the recording medium"), the melt viscosity of the binder resin is high and offset to the fixing member hardly occurs, but since the melt viscosity of the release agent is lower than the melt viscosity of the binder resin of the toner particles, the release agent excessively penetrates the recording medium before the toner particles are melted and penetrate the recording medium, the penetration of the binder resin of the melted toner particles with respect to the recording medium is easily inhibited, and the image intensity is easily decreased.

Meanwhile, there is provided the toner according to the exemplary embodiment including toner particles containing a binder resin containing a polyester resin forming a sea part and a vinyl resin forming an island part of a sea-island structure, a first release agent existing in the sea part in a domain state, and a second release agent existing in the island part in a domain state, in which, when a cross-sectional area of the second release agent is set to A1 and a cross-sectional area of the first release agent is set to B1 in a cross section of the toner particles, a relationship of $0.2 \leq A1/B1 \leq 0.8$ is satisfied.

The toner according to the exemplary embodiment has a configuration of containing the first release agent existing in the polyester resin forming the sea portion of the sea-island structure in a domain state and the second release agent existing in the vinyl resin forming the island part of the sea-island structure in a domain state at a predetermined ratio. Therefore, it is considered that if the toner according to the exemplary embodiment receives relatively weak pressure, only the first release agent may easily seep out from the toner particles, and if the toner receives relatively strong pressure, the first release agent and the second release agent easily seep out from the toner particles. That is, it is considered that a supply amount of the release agent in the toner according to the exemplary embodiment is adjusted depending on external stimuli (for example, pressurization and heating).

Accordingly, it is considered that in a case of forming an image on the recording medium which is not subjected to a smoothing process (for example, coating process and calender process) of a surface thereof and has great concavity and convexity of a surface, since the toner according to the exemplary embodiment receives relatively weak pressure on the concavity of the recording medium, only the first release agent is easily supplied, and since the toner receives relatively strong pressure on the convexity of the recording medium, the first release agent and the second release agent are easily supplied.

Therefore, in a case where heat and pressure are applied to the toner according to the exemplary embodiment to a degree that the binder resin penetrates the concavity on the recording medium, only the first release agent of the toner according to the exemplary embodiment easily seeps out from the inside of the sea part which is formed with a polyester resin. It is considered that this is because the melt viscosity of the polyester resin easily decreases compared to that of vinyl resin. Accordingly, in the toner according to the exemplary embodiment, since the excessive amount of the first release agent is not supplied to the concavity on the recording medium, it is considered that it is difficult to inhibit the penetration of the binder resin to the concavity on the recording medium.

In addition, in the toner according to the exemplary embodiment, since heat and pressure, which are greater compared to those on the concavity on the recording medium, are applied on the convexity on the recording medium, the second release agent from the inside of the island part which is formed with a vinyl resin is also supplied, in addition to the first release agent from the inside of the sea part which is formed with the polyester resin. That is, a greater amount of the release agent than that of the concavity on the recording medium is supplied. Thus, it is considered that the toner according to the exemplary embodiment on the convexity on the recording medium exists at the interface between the fixing member and the toner particles to suppress the offset.

In the toner according to the exemplary embodiment, since the release agent is efficiently supplied depending on concavity and convexity on the surface of the recording medium, an unnecessary amount of the release agent hardly seeps on the recording medium. Accordingly, in the toner according to the exemplary embodiment, even in a case of high pressure at the time of fixing when the offset easily occurs, it is considered that the amount of the release agent existing at the interface between the toner particles and the fixing member is hardly decreased. As a result, it is considered that the toner according to the exemplary embodiment stably suppresses the offset.

Since the toner according to the exemplary embodiment has the configuration described above, even in a case of forming an image on a recording medium which has a relatively long length in a process direction (for example, A3), which is a case in which amounts of heat applied at the time of fixing are easily changed between an upper end portion of the recording medium, at a fixation initial stage and a lower end portion of the recording medium at a fixation final stage, it is easy to obtain an image having no unevenness in the image intensity.

Hereinafter, the toner according to the exemplary embodiment will be described in detail.

The toner according to the exemplary embodiment is configured to include the toner particles and, if necessary, an external additive.

Toner Particles

The toner particles are configured to include, for example, the binder resin, the release agent, if necessary, a colorant, and the other additives.

Binder Resin

The binder resin contains a polyester resin and a vinyl resin.

As the polyester resin, a well-known polyester resin is used, for example.

As the polyester resin, a condensation polymer of a polyvalent carboxylic acid and a polyol is exemplified. A commercially available product or a synthesized product may be used as a polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduce of bisphenol A and propylene oxide adduct of bisphenol A). Among these, for example, aromatic diols and alicyclic diols are preferable, and aromatic diols are more preferable as the polyol.

As the polyol, a tri- or higher-valent polyol employing a crosslinked structure or a branched structure may be used in combination together with the diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and store preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "Testing methods for transition temperatures of plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using GPC manufactured by Tosoh Corporation, HLC-8120 GPC, as a measuring device column manufactured by Tosoh Corporation, TSK gel Super HM-M column (15 cm), and a THF solvent. The weight average molecular weight and the number average molecular weight are calculated using a molecular weight calibration curve plotted from monodisperse polystyrene standard samples from the results of the above measurement.

A known manufacturing method is used to manufacture the polyester resin. Specific examples thereof include a method of conducting a reaction at a polymerization temperature set to, from 18° C. to 230° C., if necessary, under reduced pressure in the reaction system, while removing water or alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolmerization reaction, the monomer having poor compatibility and acid or alcohol to be polycondensed with the monomer may be previously condensed and then polycondensed with the main component.

Vinyl Resin

Examples of the vinyl resin include a vinyl resin formed of a homopolymer of a monomer of styrene compounds (for example, styrene, p-chlorostyrene, α-methyl styrene, or the like), (meth)acrylic ester compounds (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitrile compounds (for example, acrylonitrile, methacrylonitrile, or the like), vinyl ether compounds (for example, vinyl methyl ether, vinyl isobutyl ether, or the like), vinyl ketone compounds (for example, vinyl methyl ketone, vinyl ethyl ketone, vinyl isopropenyl ketone, or the like), olefin compounds (for example, ethylene, propylene, butadiene, or the like), or a vinyl resin formed of a copolymer obtained by combining two or more kinds of the monomers. Among those, styrene compounds or acrylic acid-containing monomer compounds are preferable.

The polyester resin and the vinyl resin are not particularly limited as long as those are not compatible with each other and form a sea-island structure in which the polyester resin is set to a sea part and the vinyl resin is set to an island part, and, in a case where the same temperature and the pressure are applied thereto, a melting temperature of the polyester resin is lower than a melting temperature of the vinyl resin, and a decrease in the melt viscosity of the polyester resin is greater than a decrease in the melt viscosity of the vinyl resin.

Examples of combination of the polyester resin and the vinyl resin include 1) combination of an amorphous polyester resin having an unsaturated structure or a crosslinked structure as the polyester resin, and a polymer of polystyrene, acrylic acid, and an acrylic acid compound, a copolymer of two or more kinds from monomers of styrene, acrylic acid, and an acrylic acid compound, or a vinyl resin partially having a crosslinked structure as the vinyl resin, 2) combination of a mixture of an amorphous polyester resin and a crystalline polyester resin such as a saturated aliphatic polyester resin as the polyester resin, and a polymer of polystyrene, a polymer of acrylic acid, a polymer of an acrylic acid compound, a copolymer of two or more kinds from monomers of styrene, acrylic acid, and an acrylic acid compound, or a vinyl resin partially having a crosslinked structure as the vinyl resin, and the like. Among these, the combination of the mixture of the amorphous polyester resin and the crystalline polyester resin as the polyester resin, and the copolymer of two or more kinds from monomers of styrene, acrylic acid, and an acrylic acid compound as the vinyl resin is preferable.

A mass ratio of the polyester resin to the vinyl resin (polyester resin: vinyl resin) is preferably from 98:2 to 60:40 and more preferably from 95:5 to 70:30. If the mass ratio is from 98:2 to 60:40, the sea-island structure in which the polyester resin is set to the sea part and the vinyl resin is set to the island part is easily formed in the binder resin.

The sea-island structure in which the polyester resin is set to the sea part and the vinyl resin is set to the island part and the domain structure of the first release agent and the second release agent are checked with the following method. After mixing and embedding the toner according to the exemplary embodiment in an epoxy resin and solidifying the mixture overnight, a flake having a thickness of 80 nm to 130 nm is prepared using an ultramicrotome (Ultracut UCT manufactured by Leica Microsystems, Ltd.). The obtained flake is dyed with osmium tetroxide in a desiccator at 30° C. for 3 hours, and the dyed flake is observed using an ultrahigh-resolution field-emission scanning electron microscope (S-4800 manufactured by Hitachi High-Technologies Corporation) to check the configuration of the toner particles. Herein, since the polyester resin, the vinyl resin, and the release agent in this order are easily dyed with osmium tetroxide, the configuration of shading caused by dyed degrees is checked for the configuration of the toner particles. In a case where the shading is difficult to determine due to the state of the sample, the dyeing time may be adjusted. In addition, after performing the dyeing process with osmium tetroxide and observing the observation flake, the dyeing process with osmium tetroxide and the observation are further performed to compare respective images, and accordingly the sea-island structure of the resins or the domain state of the first release agent and the second release agent may be checked.

Examples of the other binder resin include an epoxy resin, a polyester resin, a polyurethane resin, a polyamide resin, a cellulose resin, a polyether resin, and modified rosin.

The binder resins may be used alone as one kind or may be used in combination of two or more kinds.

The content of the binder resin is preferably from 40% by weight to 95% by weight, more preferably from 50% by weight to 90% by weight, and even more preferably from 60% by weight to 85% by weight, based on the total amount of the toner particles.

Release Agent

The release agent is not particularly limited as long as it has a low melting temperature or melt viscosity compared to that of the polyester resin and the vinyl resin.

The toner according to the exemplary embodiment includes the first release agent and the second release agent. The first release agent is a release agent existing in the polyester resin forming the sea portion of the sea-island structure in a domain state, and the second release agent is a release agent existing in the vinyl resin forming the island part of the sea-island structure in a domain state.

The first release agent and the second release agent may be the same type or different types from each other.

Examples of the release agent include hydrocarbon-based waxes; natural waxes such as carnauba wax, rice wax, and candelilla wax; synthetic or mineral/petroleum-based waxes such as montan wax; ester-based waxes such as fatty acid esters and montanic acid esters, synthetic waxes such as Fischer Tropsch Wax and polyethylene wax; and modified waxes thereof. The mineral or synthetic paraffin wax is particularly preferable, but the release agent is not limited thereto.

A ratio A1/B1 of a cross-sectional area B1 of the first release agent and a cross-sectional area A1 of the second release agent is from 0.2 to 0.8, preferably from 0.3 to 0.7, and more preferably from 0.4 to 0.0. If the ratio A1/B1 is from 0.2 to 0.8, in a case of forming a half-tone image on the recording medium having great convexity and concavity of the surface, the exuding of the first release agent and the second release agent from the toner particles is adjusted depending on the heat and pressure applied to the toner particles on the convexity on the recording medium and the concavity on the recording medium, the offset is suppressed, and an image having high image intensity is easily formed.

The cross-sectional area B1 of the first release agent and the cross-sectional area A1 of the second release agent on the cross section of the toner particles are calculated as follows.

The image observed with the ultrahigh-resolution field-emission scanning electron microscope (S-4800 manufactured by Hitachi High-Technologies Corporation) is digitized and is introduced to image analysis software (WinROOF) manufactured by Mitani Corporation to acquire the cross-sectional area B1 of the first release agent and the cross-sectional area A1 of the second release agent on the cross section of the toner particles with the following procedure, for example.

After selecting a toner cross-sectional region as a selection target, a binarization processing is performed using "Automatic Binarization—Discriminant Analysis Method" of the command of "Binarization Processing". With respect to each extracted release agent domain, a release agent domain directly existing in the sea part of the polyester resin is selected as the first release agent and the total area is measured to set to the cross-sectional area B1, and a release agent domain, which is surrounded by the sea part of the polyester resin and a region (island part of the vinyl resin) different from the release agent domain directly existing in the sea part of the polyester resin is selected as the second release agent and the cross-sectional area A1 is measured.

When a part of the release agent domain is surrounded by the region (island part of the vinyl resin) different from the release agent domain directly existing in the sea part of the polyester resin and the other part comes into contact with the sea part of the polyester resin, a boundary length of the release agent domain and a distance in which the other part thereof comes into contact with the sea part of the polyester resin are measured and in a case where 30% or more of the sea part of the polyester resin with respect to the boundary length of the release agent domain comes into contact with the part thereof, the part thereof is determined as the first release agent and is added to the cross-sectional area B1, and in a case where the contact portion with the sea part of the polyester resin is less than 30%, the part thereof is determined as the second release agent and is added to the cross-sectional area A1.

In a case where the automatic binarization is not normally performed due to imaging density or noise of a photograph, an image is sharpened by performing a "median, filter" process or an edge extraction process, or a position, is manually set while checking an image in a manual binarization command, and then the cross-sectional area B1 and the cross-sectional area A1 may be measured.

The ratio A1/B1 is calculated from the obtained cross-sectional area B1 of the first release agent and cross-sectional area A1 of the second release agent.

The melting temperature of the release agent is preferably from 50° C. to 110° C., and more preferably from 60° C. to 100° C.

The melting temperature is obtained from "melting peak temperature" described in the method of obtaining a melting temperature in JIS K7921-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight based on the total amount of the toner particles.

Colorant

Examples of the colorant include various pigments such as carbon black, chrome yellow, Hansa yellow, benzidine yellow, threne yellow, quinoline yellow, Pigment Yellow, Permanent Orange GTR, pyrazolone orange, Vulcan Orange, Watchung Red, Permanent Red, Brilliant Carmine 3B, Brilliant Carmine 6B, Dupont oil red, pyrazolone red, lithol red, Rhodamine B Lake, Lake Red C, Pigment Red, Rose Bengal, Aniline Blue, ultramarine blue, Calco oil blue, methylene blue chloride, phthalocyanine blue, Pigment Blue, phthalocyanine green, and malachite green oxalate, or various dyes such as acridine, xanthene, azo, benzoguinone, azine, anthraquinone, thioindigo, dioxazine, thiazine, azomethine, indigo, phthalocyanine, aniline black, polymethine, triphenylmethane, diphenylmethane, and thiazole dyes.

The colorant may be used alone as one kind or may be used in combination of two or more kinds.

As the colorant, a surface-treated colorant may be used or a dispersant may be used in combination, if necessary. In addition, plural types of colorants may be used in combination.

The content of the colorant is, for example, preferably from 1% by weight to 30% by weight and more preferably from 3% by weight to 15% by weight, based on the total amount of the toner particles.

Other Additives

Examples of other additives include known additives such as a magnetic material, a charge-controlling agent, and an inorganic powder. The toner particles include these additives as internal additives.

Properties of Toner Particles

The toner particles may be toner particles having a single-layered structure, and may be toner particles having a so-called core shell structure configured with a core Score particle) and a coating layer (shell layer) which covers the core.

The toner particles having a core shell structure are preferably configured with a core which is configured by containing a binder resin, and if necessary, the other additive such as a colorant and a release agent, and a coating layer which is configured by containing a binder resin, for example.

It is preferable that 60% or more of the polyester resin exists on the surface of the toner particles, and it is more preferable that 80% or more thereof exists in the surface of the toner particles.

If the 60% or more of the polyester resin exists on the surface of the toner particles, the polyester resin having a greater polarity compared to that of the vinyl resin which is the binder resin exists in the surface of the toner particles, and accordingly the toner particles are easily fit into the recording medium (for example, paper) and are easily attached to the recording medium even with relatively low temperature or pressure. Therefore, the toner particles are hardly moved on the surface of the recording medium in a fixation initial stage and pass through the fixation final stage in this state, and image unevenness due to the movement of the toner particles to the concavity of the recording medium, for example, hardly occurs.

A ratio of the polyester resin existing in the surface of the toner particles is calculated as follows, for example. Using a photoelectron spectroscope device JSP9000MX manufactured by JEOL, Ltd., the toner particles are evenly spread in a powder sample holder and measurement is performed under conditions with applying a voltage of 8 kV, an emission current of 8 mA, a path energy of 8 eV, and 100 times of scanning. A C1s peak is divided into a peak configured with a molecular structure derived from the polyester resin and a peak configured with a molecular structure derived from the vinyl resin, and a ratio of the polyester resin is calculated from each peak area. A waveform for separating the C1s peak may be acquired using a measured value of the polyester resin single body and a measured value of the vinyl resin single body. In addition, it is possible to check that the toner particles include the polyester resin and the vinyl resin as follows.

Approximately 20 mg of the toner particles is weighed in a sample bottle, 1 mL of heavy chloroform as a solvent is added thereto and the toner particles are sufficiently dissolved therein, and the solution is moved to a nuclear magnetic resonance (NMR) sample tube (ϕ of 5 mm) to perform NMR spectrometry.

Measurement device: JNM-AL400 FT-NMK manufactured by JEOL, Ltd.

Measurement Conditions

Sample container: NMR sample tube having ϕ of 5 mm

Solvent: heavy chloroform solution

Sample temperature: 20° C.

Observation nucleus: 1H

Cumulated number: 128

Standard: tetramethylsilane (TMS)

The spectrum analysis of the measurement result is performed, and a peak integral originated from the polyester resin component in a range of 9 ppm to 7 ppm is detected, and a peak integral originated from the vinyl resin component in a range of 4 ppm to 3 ppm is detected, and accordingly it may be checked that each resin is included in the toner particles.

The ratio of the vinyl resin with respect to the polyester resin in the toner particles may also be calculated from each peak integral.

A volume particle diameter (D50v) of the toner particles is preferably from 2 μm to 10 μm and more preferably from 4 μm to 8 μm.

Various particle diameters and various particle size distribution indexes of the toner particles are measured using Coulter Multisizer II (manufactured by Beckman Coulter Inc.) and ISOTON-II (manufactured by Bechman Coulter Inc.) as an electrolyte solution.

At the time of measurement, 0.5 mg to 50 mg of a measurement sample is added to 2 mL of 5% aqueous solution of a surfactant (preferably sodium alkylbenzene sulfonate) as a dispersant. This is added in 100 mL to 150 mL of the electrolyte solution.

The electrolyte solution in which the sample is suspended is subjected to dispersion treatment with an ultrasonic dispersion device for 1 minute, and the particle size distribution of the particles having a particle size in a range of 2 μm to 60 μm is measured using an aperture of 100 μm as an aperture diameter with Coulter Multisizer II. The number of particles for sampling is 50000.

Cumulative distribution of the volume and the number is drawn from each smaller diameter side with respect to a particle site range (channel) which is divided based on the measured particle size distribution. The volume particle diameter is set to D16v and the number particle diameter is set to D16p for the particle diameter with 16% cumulation, the volume particle diameter is set to D50v and the number particle diameter is set to D50p for the particle diameter with 50% cumulation, and the volume particle diameter is set to D84v and the number particle diameter is set to D84p for the particle diameter with 84% cumulation.

Using this, a volume average particle size distribution index (GSDv) is calculated as $(D84v/D16v)^{1/2}$, and a number average particle size distribution index (GSDp) is calculated as $(D84p/D16p)^{1/2}$.

A shape factor SF1 of the toner particles is preferably from 110 to 150 and more preferably from 120 to 140.

The shape factor SF1 is acquired with the following formula.

$$\text{Formula: } SF1=(ML^2/A)\times(\pi/4)\times 100$$

In Formula, ML represents an absolute maximum length of the toner particles, and A represents a projected area of the toner particles.

In detail, the shape factor SF1 is digitized by analyzing mainly a microscopic image or a scanning electron microscopic (SEM) image using an image analyzer, and is calculated as follows. That is, an optical microscopic image of particles scattered on a surface of a glass slide is put in LUZEX, an image analyzer by a video camera, each maximum length and projection area are acquired for 190 particles, and calculation is performed with the Formula and SF1 is obtained by acquiring an average value thereof.

External Additive

As an external additive, inorganic particles are used, for example. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, $SrTiO_3$, and the like.

The surface of the inorganic particles as the external additive may preferably be subjected to hydrophobic treatment. The hydrophobic treatment is performed by immersing the inorganic particles in a hydrophobizing agent, for example. The hydrophobizing agent is not particularly limited, and examples thereof include a silane coupling agent, silicone oil, a titanate coupling agent, an aluminum coupling agent, and the like. The components may be used alone or in combination of two or more kinds.

An amount of the hydrophobizing agent is normally, for example, from 0.5 part by weight to 10 parts by weight with respect to 100 parts by weight of the inorganic particles.

As the external additive, a resin particle (resin particle of polystyrene, polymethylmethacrylate (PMMA), melamine resin or the like), a cleaning activator (for example, metallic salt of higher fatty acid representative of zinc stearate, fatty acid, and particle of fluorine polymer), or the like is used.

An external addition amount of the external additive such as the resin particle or the cleaning lubricant is preferably from 0.01% by weight to 5% by weight and more preferably from 0.01% by weight to 2.0% by weight, with respect to the toner particles, for example.

Manufacturing Method of Toner

Next, a manufacturing method of the toner according to the exemplary embodiment will be described.

The toner according to the exemplary embodiment is obtained by preparing the toner particles and then adding the external additive with respect to the toner particles.

The toner particles may be prepared by any of a drying preparing method (for example, kneading and pulverizing method), and a wet preparing method (for example, aggregation and coalescence method, suspension polymerization method, dissolution and suspension method).

Among them, it is preferable to obtain the toner particles by the aggregation and coalescence method.

In detail, when preparing the toner particles by the kneading and pulverizing method, for example, the vinyl resin and the release agent is kneaded using a continuous kneader by applying a high shearing force to prepare a release agent dispersed vinyl resin in which the release agent is dispersed in the vinyl resin, and the release agent dispersed vinyl resin, the polyester resin, the release agent, and if necessary, the colorant or a charge-controlling agent, each of which is crushed and premixed, are melted and kneaded with a twin screw kneading extruder, and then pulverization and classification are performed to obtain mixture particles. After dispersing the mixture particles in water, polyester resin particle dispersion having a particle diameter of a tenth to a thousandth of the particle diameter of the mixture particles is added dropwise while stirring, the polyester resin particles are attached to the surface of the mixture particles using a polarity of aggregating agent or a surfactant, a temperature thereof is maintained to be equal to or higher than a glass transition temperature of the polyester resin particles while stirring, and the polyester resin particles are fixed to the surface of the mixture particles to obtain polyester-resin-particles-covered mixture particles. By washing and drying the polyester-resin-particles-covered mixture particles, the toner particles may be obtained.

When preparing the toner particles by the aggregation and coalescence method, for example, the toner particles are prepared by performing a step (resin particle dispersion preparing step) of preparing a resin particle dispersion (polyester resin dispersion and vinyl resin particle dispersion) in which a resin particle which is a binder resin is dispersed, a step (release agent particle dispersion preparing step) of preparing a release agent particle dispersion in which a release agent particle is dispersed, a step (mixed solution preparing step) of mixing the release agent particle dispersion and the vinyl resin particle dispersion and preparing a composite particle mixed solution in which composite particles obtained by mixing the resin and the release agent (hereinafter, referred to as "composite particles") are dispersed, a step (aggregation particle forming step) of aggregating the polyester resin particle, the vinyl resin aggregation particle, and the release agent particle (and if necessary other particles) in the resin particle dispersion (in the dispersion after mixing the other particle dispersion if necessary) and forming an aggregation particle, and a step (coalescence step) of performing heating the aggregation particle dispersion in which the aggregation particle is dispersed, performing coalescence of the aggregation particle, and forming the toner particle.

Hereinafter, each step will be described in detail.

In the following description, the method of obtaining the toner particles which contain the colorant and the release agent will foe described, but the colorant is used if necessary. Of course, the other additives other than the colorant may foe used.

Resin Particle Dispersion Preparing Step

First, the resin particle dispersion in which the resin particle which is the binder resin is dispersed, the release agent particle dispersion in which the release agent particle is dispersed, and for example, the colorant particle dispersion in which the colorant particle is dispersed, are prepared. Herein, the resin particle dispersion includes at least the polyester resin dispersion and the vinyl resin dispersion.

Herein, the resin particle dispersion is prepared by dispersing the resin particle obtained by synthesizing a monomer, in a dispersion medium by a surfactant, for example.

An aqueous medium is used, for example, as the dispersion medium used in the resin particle dispersion.

Examples of the aqueous medium include water such as distilled water, ion exchange water, or the like, alcohols, and the like. The medium may be used alone or in combination of two or more kinds.

Examples of the surfactant include an anionic surfactant such as a sulfuric ester salt, sulfonate, phosphate ester, or soap; a cationic surfactant such as amine salt, or quaternary ammonium salt; and a nonionic surfactant such as polyethyleneglycol, alkylphenol ethylene oxide adduct, or polyols. Among them, the anionic surfactant and the cationic surfactant are particularly used. The nonionic surfactant may be used in combination with the anionic surfactant or the cationic surfactant.

The surfactant may be used alone or in combination of two or more kinds.

In the resin particle dispersion, as a method of dispersing the resin particle in the dispersion medium, a typical dispersing method using a rotating shear type homogenizer, a ball mill, a sand mill, and a DYNO-mill having media, is used. According to the type of the resin particle, the resin particle may be dispersed in the resin particle dispersion using a phase-transfer emulsification method, for example.

The phase-transfer emulsification method is a method of dissolving the resin to be dispersed in a hydrophobic organic solvent in which the resin is soluble, neutralizing the resin by adding a base to the organic continuous phase (O phase), and then putting an aqueous medium (W phase) therein, making a discontinuous phase by performing conversion of the resin (so-called phase transfer) from W/O to O/W, and dispersing the resin in the aqueous medium in a particle shape.

The volume average particle diameter of the resin particles dispersed in the resin particle dispersion is, for example, preferably from 0.01 μm to 1 μm, more preferably from 0.08 μm to 0.6 μm and even more preferably from 0.1 μm to 0.6 μm.

The volume average particle diameter of the resin particles is obtained by drawing cumulative distribution of volume from the smaller diameter side with respect to the divided, particle size range (channel), using the particle size distribution obtained by measurement with a laser diffraction type particle size distribution measuring device (for example, LA-700 manufactured by Horiba, Ltd.). The particle diameter with 50% volume with respect to the entirety of the particles is measured as a volume average particle diameter D50p. In addition, the volume average particle diameter of the particle in the other dispersion is also measured in the same manner.

Content of the resin particles contained in the resin particle dispersion is preferably from 5% by weight to 50% by weight and more preferably from 10% by weight to 40% by weight.

Release Agent Particle Dispersion Preparing Step

The release agent particle dispersion is also prepared in the same manner as that of the resin particle dispersion. The volume average particle diameter of the particle, the dispersion medium, the dispersing method, and the content of the particle for the resin particle dispersion are the same as for the release agent particle which is to be dispersed in the release agent particle dispersion.

The colorant dispersion is also prepared, for example, in the same manner as the resin particle dispersion. The volume average particle diameter of the particle, the dispersion medium, the dispersing method, and the content of the particle for the resin particle dispersion are the same as for the colorant particle which is to be dispersed in the colorant particle dispersion.

Mixed Solution Preparing Step

In the step (mixed solution preparing step) of mixing the release agent particle dispersion and the vinyl resin particle dispersion and preparing the composite particle mixed solution in which the composite particles obtained by mixing the resin and the release agent are dispersed, the vinyl resin particle dispersion and the release agent particle dispersion are mixed with each other and the aggregating agent is added dropwise thereto to prepare the composite particle mixed solution. In this case, the composite particle in which the release agent particle and the vinyl resin particle are aggregated, is obtained.

As the aggregating agent, for example, a surfactant having a polarity opposite to that of the surfactant which is used as a dispersant to be added to the mixed dispersion, for example, inorganic metallic salt or a divalent or a higher valent metallic complex, is used. Particularly, when using the metallic complex as the aggregating agent, the used amount of the surfactant is decreased and the charging property is improved.

The mixed solution preparing step is not limited thereto, and the composite particle mixed solution is also prepared by adding the vinyl resin particle dispersion to the release agent particle dispersion dropwise and heating. In this case, the composite particle in which the vinyl resin particle is attached to the surface of the release agent particle is obtained. In addition, by using the surfactants in which a charging property of the surfactant for dispersing the vinyl resin particle opposes a charging property of the surfactant for dispersing the release agent particle, the vinyl resin particle may be attached to the surface of the release agent by an electrostatic force.

Aggregation Particle Forming Step

Next, the polyester resin particle dispersion, the mixed solution, the release agent particle dispersion, and the colorant particle dispersion are mixed with each other.

Then, the resin particle, the vinyl resin aggregation particle, the release agent particle, and the colorant particle are subject to heteroaggregation in the mixed dispersion, and an aggregation particle containing the resin particle, the vinyl resin aggregation particle, the release agent particle, and the colorant particle having a diameter close to the target diameter of the toner particle is formed.

In detail, for example, an aggregating agent is added to the mixed dispersion and pH of the mixed dispersion is adjusted to acidify (for example, pH from 2 to 5), a dispersion stabilizer is added if necessary, and then the resultant material is heated to the glass transition temperature (in detail, for example, from a temperature 30° C. lower than the glass transition temperature of the resin particle to a temperature 10° C. lower than the glass transition temperature) of the resin particle, and the particle dispersed in the mixed dispersion is aggregated to form the aggregation particle.

In the aggregation particle forming step, for example, while stirring the mixed dispersion with a rotating shear type homogenizer, the aggregating agent is added at a room temperature (for example, 25° C.), pH of the mixed dispersion, is adjusted to acidity (for example, pH from 2 to 5), the dispersion stabilizer is added if necessary, and then the heating may be performed.

As the aggregating agent, for example, a surfactant having a polarity opposite to that of the surfactant which is used as a dispersant to be added to the mixed dispersion, for example, inorganic metallic salt or a divalent or a higher valent metallic complex, is used. Particularly, when using the metallic complex as the aggregating agent, the used amount of the surfactant is decreased and the charging property is improved.

An additive for forming a complex or a similar bond with a metallic ion of the aggregating agent may be used, if necessary. A chelating agent is preferably used as the additive.

Examples of the inorganic metallic salt include metallic salt such as calcium chloride, calcium nitrate, barium chloride, magnesium chloride, zinc chloride, aluminum chloride, or aluminum sulfate, inorganic metallic salt polymer such as polyaluminum chloride, polyaluminum hydroxide, calcium polysulfide, and the like.

A water-soluble chelating agent may be used as the chelating agent. Examples of the chelating agent include oxycarboxylic acid such as tartaric acid, citric acid, or gluconic acid, iminodiacetic acid (IDA), nitrilotriacetic acid (NTA), ethylenediaminetetraacetic acid (EDTA), and the like.

The added amount of the chelating agent is, for example, preferably from 0.01 part by weight to 5.0 parts by weight with respect to 100 parts by weight of the resin particles, and mere preferably equal to or more than 0.1 part by weight and less than 3.0 parts by weight.

Coalescence Step

Next, the aggregation particle dispersion in which the aggregation particle is dispersed is heated to the glass transition temperature of the resin particle or higher (equal to or higher than a temperature which is 10° C. to 30° C. higher than the glass transition temperature of the resin particle) the aggregation particle is subject to coalescence, and the toner particle is formed.

The toner particle is obtained by performing the above steps.

After obtaining the aggregation particle dispersion in which the aggregation particle is dispersed, a step of further mixing the aggregation particle dispersion and the resin particle dispersion in which the resin particle is dispersed, and performing aggregation so that the resin particle is further attached to the surface of the aggregation particle, to form a second aggregation, particle, and a step of heating second aggregation particle dispersion in which the second aggregation particle is dispersed, performing coalescence of the second aggregation particle, and forming the toner particle having a core shell structure, may be performed to prepare the toner particle.

The polyester resin is preferable as the resin particle to be aggregated so as to be attached to the surface of the aggregation particle.

Herein, after completing the coalescence step, a well-known washing step, solid-liquid separation step, and drying step are performed for the toner particle formed in a solution and the toner particle in a dried state is obtained.

In the washing step, displacement washing by the ion exchange water is preferably performed sufficiently from a viewpoint of a charging property. The solid-liquid separation step is not particularly limited. However, suction filtration or pressurization filtration is preferably performed from a viewpoint of productivity. In addition, the method of the drying step is not particularly limited. However, freeze-drying, flash jet drying, fluidized drying, vibration type fluidized drying, or the like is preferably performed from a viewpoint of productivity.

The toner according to the exemplary embodiment is prepared by adding and mixing the external additive to the obtained toner particles in the dried state. The mixing is preferably performed with a V-blender, a Henschel mixer, a Loedige mixer, or the like, for example. In addition, if necessary, the coarse particles of the toner may be removed using a vibration classifier or a wind classifier.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which the surface of a core formed of a magnetic powder is coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by airflow, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging step of charging a surface of an image holding member, an electrostatic charge image forming step of forming an electrostatic charge image on a charged surface of the image holding member, a developing step of developing the electrostatic charge image formed on the surface of the image holding member with the electrostatic charge image developer according to this exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image, a surface of an image holding member before charging; or an apparatus that is provided with an erasing unit that irradiates, after transfer of a toner image, a surface of an image holding member with erasing light before charging to perform erasure.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, the image forming apparatus is not limited thereto. Major parts shown in the drawings will be described, and descriptions of other parts will be omitted.

FIG. 1 is a schematic configuration diagram showing the image forming apparatus according to the exemplary embodiment.

The image forming apparatus shown in FIG. 1 includes first to fourth electrophotographic image forming units 10Y, 10M, 10C, and 10K (image forming units) that output images of each color such as yellow (Y), magenta (M), cyan (C), and black (K) based on image data which is subjected to color separation. The image forming units (hereinafter, simply referred to "units" in some cases) 10Y, 10M, 10C, and 10K are provided in a line to be separated from each other at predetermined intervals in a horizontal direction. The units 10Y, 10M, 10C, and 10K may be a process cartridge which is detachable from the image forming apparatus.

An intermediate transfer belt 20 as an intermediate transfer member is provided to be extended through each unit, on the upper portion of units 10Y, 10M, 10C, and 10K in the drawing. The intermediate transfer belt 20 is provided to be wound around a driving roller 22, and a support roller 24 which comes into contact with an inner surface of the intermediate transfer belt 20, which are disposed to be separated from each other in a left to right direction in the drawing, and are configured to travel in a direction from the first unit 10Y to the fourth unit 10K. A force is applied to the support roller 24 in a direction separating from the driving roller 22 by a spring or the like (not shown), and tension is applied to the intermediate transfer belt 20 which is wound around both rollers. An intermediate transfer member cleaning device 30 is provided to oppose the driving roller 22, on an image holding member side surface of the intermediate transfer belt 20.

Each toner of yellow, magenta, cyan, and black accommodated in toner cartridges 8Y, 8M, 8C, and 8K is supplied to each developing device (the developing unit) 4Y, 4M, 4C, and 4K of units 10Y, 10M, 10C, and 10K, respectively.

Since the first to fourth units 10Y, 10M, 10C, and 10K have the same configuration, the first unit 10Y which is disposed upstream of the intermediate transfer belt in a travelling direction and forms a yellow image will be described as a representative unit. Reference signs with magenta (M), cyan (C), and black (K) are denoted instead of yellow (Y) for the same part as the first unit 10Y, and therefore the description of the second to fourth units 10M, 10C, and 10K will be omitted.

The first unit 10Y includes a photoreceptor 1Y which operates as the image holding member. A charging roller (one example of the charging unit) 2Y which charges a surface of the photoreceptor 1Y to a predetermined potential, an exposing device (one example of the electrostatic charge image forming unit) 3 which exposes a charged surface by a laser beam 3Y based on an image signal subjected to color separation, to form an electrostatic charge image, a developing device (one example of the developing unit) 4Y which supplies charged toner to the electrostatic charge image to develop the electrostatic charge image, a primary transfer roller 5Y (one example of the primary transfer unit) which transfers the developed toner image onto the intermediate transfer belt 20, and a photoreceptor cleaning device (one example of the cleaning unit) 6Y which removes toner remaining on the surface of the photoreceptor 1Y after the primary transfer are placed around the photoreceptor 1Y in this order.

The primary transfer roller 5Y is placed inside of the intermediate transfer belt 20 and is provided in a position opposing the photoreceptor 1Y. A bias power supply (not shown) which applies primary transfer bias is connected to each of the primary transfer rollers 5Y, 5M, 5C, and 5K. Each bias power supply changes transfer bias to be applied to each primary transfer roller, by control of a control unit (not shown).

Hereinafter, an operation of forming a yellow image in the first unit 10Y will be described.

First, the surface of the photoreceptor 1Y is charged to a potential of −600 V to −800 V by the charging roller 2Y, before the operation.

The photoreceptor 1Y is formed by laminating a photosensitive layer on a conductive (for example, $1\times10^{-6}$ Ωcm or less of volume resistivity at 20° C.) substrate. The photosensitive layer normally has high resistivity (resistivity of a general resin), but has a property in that specific resistance of a portion to which the laser beam is emitted changes if the laser beam 3Y is emitted. Herein, the laser beam 3Y is output to a charged surface of the photoreceptor 1Y through the exposing device 3, according to yellow image data which is transmitted from, the control unit (not shown). The laser beam 3Y is emitted to a photosensitive layer of the surface of the photoreceptor 1Y, and accordingly, an electrostatic charge image having a yellow image pattern is formed on the surface of the photoreceptor 1Y.

The electrostatic charge image is an image which is formed on the surface of the photoreceptor 1Y by charging, and is a so-called negative latent image which is formed as the result that the specific resistance of the irradiated portion of the photosensitive layer with the laser beam 3Y decreases, an electrical charge charged on the surface of the photoreceptor 1Y flows, and meanwhile the charge on the portion to which the laser beam 3Y is not emitted remains.

The electrostatic charge image which is formed on the photoreceptor 1Y rotates to a development position which is predetermined according to the travelling of the photoreceptor 1Y. The electrostatic charge image on the photoreceptor 1Y is visualized (developed) as a toner image by the developing device 4Y in this development position.

An electrostatic charge image developer including at least a yellow toner and a carrier is accommodated in the developing device 4Y, for example. The yellow toner is friction-charged by agitation in the developing device 4Y, and has a charge with the same polarity (negative polarity) as the charge which is charged on the photoreceptor 1Y and is held on a developer roller (one example of a developer holding member). As the surface of the photoreceptor 1Y passes through the developing device 4Y, the yellow toner is electrostatically attached to an erased latent image portion on the surface of the photoreceptor 1Y, and a latent image is developed by the yellow toner. Then, the photoreceptor 1Y on which the yellow toner image is formed travels continuously at a predetermined speed, and the toner image which is developed on the photoreceptor 1Y is carried to a predetermined primary transfer position.

When the yellow toner image on the photoreceptor 1Y is carried to the primary transfer position, the primary transfer bias is applied to the primary transfer roller 5Y, an electrostatic force directed from the photoreceptor 1Y towards the primary transfer roller 5Y acts on the toner image, and the toner image on the photoreceptor 1Y is transferred onto the intermediate transfer belt 20. The transfer bias applied at that time has a polarity (+) opposite to the polarity (−) of the toner, and is controlled to, for example, +10 μA by the control unit (not shown) in the first unit 10Y.

Meanwhile, the toner remaining on the photoreceptor 1Y is removed and collected by the photoreceptor cleaning device 6Y.

The primary transfer bias to be applied to the primary transfer rollers 5M, 5C, and 5K of the second unit 10M and the subsequent units is controlled based on the first unit.

Accordingly, the intermediate transfer belt 20 to which the yellow toner image is transferred in the first unit 10Y is sequentially carried through the second to fourth units 10M, 10C, and 10K, and each color toner image is transferred in a superimposed manner.

The intermediate transfer belt 20 to which the toner images with four colors are transferred in a superimposed manner through the first to fourth units, approaches a secondary transfer portion which is configured with the intermediate transfer belt 20, the support roller 24 which comes into contact with the inner surface of the intermediate transfer belt, and the secondary transfer roller (one example of the secondary transfer unit) 26 which is placed on the image holding surface side of the intermediate transfer belt 20. In contrast, recording paper (one example of the recording medium) P is fed into a gap in which the secondary transfer roller 26 comes into contact with the intermediate transfer belt 20, through a supplying mechanism at predetermined timing, and the secondary transfer bias is applied, to the support roller 24. The transfer bias applied at that time has the same polarity (−) as the polarity (−) of the toner, an electrostatic force from the intermediate transfer belt 20 towards the recording paper P acts on the toner image, and the toner image on the intermediate transfer belt 20 is transferred to the recording paper P. The secondary transfer bias at that time is determined based on resistivity detected by a resistivity detecting unit (not shown) which detects the resistivity of the secondary transfer portion, and is voltage-controlled.

After that, the recording paper is sent to a nipping portion of a pair of fixing rollers of a fixing device (one example of the fixing unit) 28, the toner image is fixed onto the recording paper P, and a fixed image is formed.

As the recording paper P to which the toner image is transferred, plain paper which is used in an electrophotographic copying machine or printer is used, for example. As the recording medium, an OHP sheet is also used in addition to the recording paper P.

In order to further improve smoothness of the image surface after the fixation, it is preferable that the surface of the recording paper P is smooth, and for example, coated paper obtained by coating a surface of plain paper with a resin or the like, or art paper for printing is preferably used.

The recording paper P on which the fixation of a color image is completed, is discharged towards a discharging unit, and a sequence of a color image forming operation ends.

Process Cartridge/Toner Cartridge

The process cartridge according to the exemplary embodiment will be described.

The process cartridge according to the exemplary embodiment is a process cartridge which includes a developing unit which accommodates the electrostatic charge image developer according to the exemplary embodiment and develops an electrostatic charge image formed on a surface of an image holding member as a toner image by the electrostatic charge image developer, and is detachable from the image forming apparatus.

Without being limited to the configuration described above, the process cartridge according to the exemplary embodiment may have a configuration including a developing device and, if necessary, at least one selected from other units such as the image holding member, the charging unit, an electrostatic charge image forming unit, and a transfer unit.

Hereinafter, an example of the process cartridge according to the exemplary embodiment will be shown. However, the process cartridge is not limited thereto. Major parts shown in the drawings will be described, and descriptions of other parts will be omitted.

Figure 2:
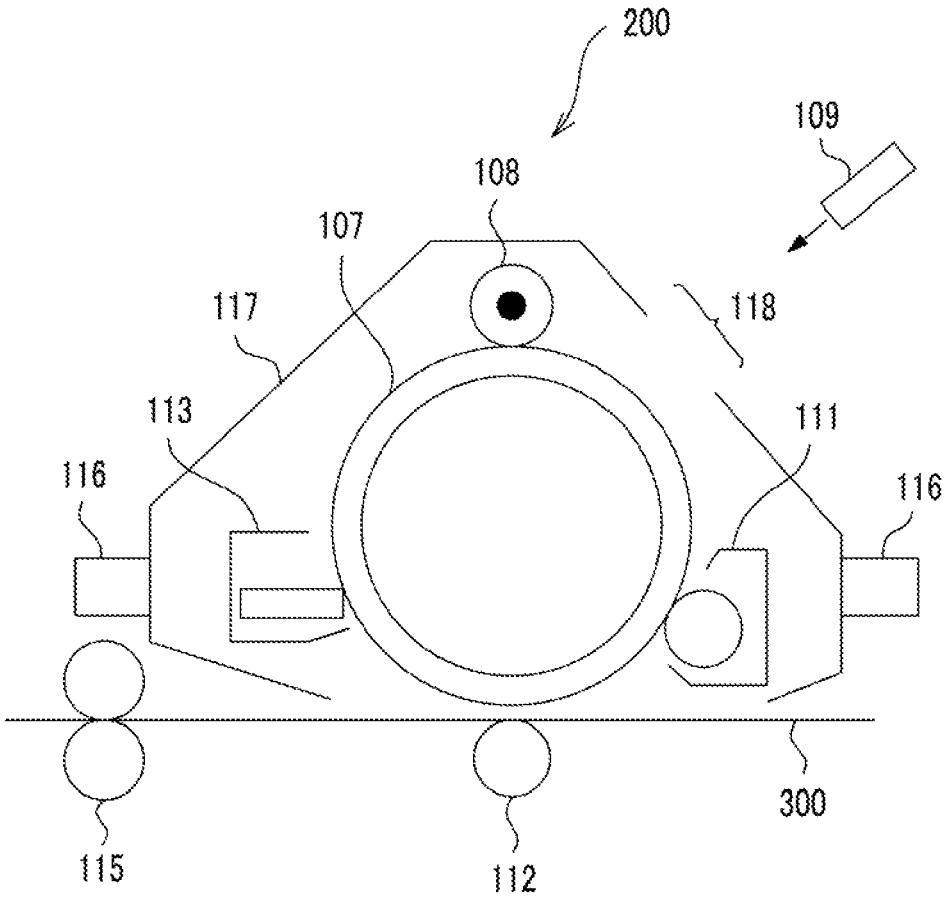
FIG. 2 is a schematic configuration diagram showing an example of a process cartridge according to the exemplary embodiment.

FIG. 2 is a schematic configuration diagram showing the process cartridge according to the exemplary embodiment.

A process cartridge 200 shown in FIG. 2 is, for example, configured by integrally combining and holding a photoreceptor 107 (an example of image holding member), a charging roll 108 (an example of charging unit), a developing device 111 (an example of developing unit), and a photoreceptor cleaning device 113 (an example of cleaning unit) which are provided around the photoreceptor 107, by attachment rails 116 and a housing 117 with an opening portion 118 for exposing light, and is configured as a cartridge.

In FIG. 2, reference numeral 109 denotes an exposing device (an example of electrostatic charge image forming unit), reference numeral 112 denotes a transfer device (an example of transfer unit), reference numeral 115 denotes a fixing device (an example of fixing unit), and reference numeral 300 denotes a recording paper (an example of recording medium).

Next, a toner cartridge according to the exemplary embodiment will be described.

The toner cartridge according to the exemplary embodiment may be configured so as to accommodate the toner according to the exemplary embodiment and to be detachable from the image forming apparatus. The toner cartridge accommodates toner for replenishment to be supplied to the developing unit provided in the image forming apparatus.

The image forming apparatus shown in FIG. 1 is an image forming apparatus having a configuration in which the toner cartridges 8Y, 8M, 8C, and 8K are detachable, and the developing devices 4Y, 4M, 4C, and 4K are connected to the toner cartridges corresponding to each developing device (color) via a toner supply tube (not shown). In addition, when the toner accommodated in the toner cartridge runs low, the toner cartridge may be replaced.

EXAMPLES

Hereinafter, this exemplary embodiment will be described in more detail using examples, but is not limited to the following examples. In the following description, unless specifically noted, "parts" and mean "parts by weight" and "% by weight".

Preparation of Toner Particles

Preparation of Toner Particles (1)

Preparation of Styrene Resin Particle Dispersion (1)

Styrene: 190 parts

Acrylic acid: 10 parts

Anionic surfactant (DOWFAX manufactured by Dow Chemical Company): 5 parts

Ion exchange water: 735 parts 190 parts of styrene monomer and 10 parts of acrylic acid are mixed and dissolved with each other and a mixed solution is prepared.

Meanwhile, 5 parts of the anionic surfactant is dissolved in 700 parts of the ion exchange water and the obtained solution is accommodated in a 2 L flask, the mixed solution described above is added therein, dispersed, and emulsified, an ammonium persulfate solution is put therein at a rate of 35 parts/60 min while stirring and mixing the mixed solution with a semi-circular shaped stirring blade at 10 rpm, and a styrene resin particle dispersion (1) is prepared. Herein, the ammonium persulfate solution is prepared by dissolving 5 parts of ammonium persulfate in 35 parts of the ion exchange water.

Preparation of Release Agent Particle Dispersion (1)

Paraffin Wax (HNP0190: manufactured by Nippon Seiro Co., Ltd., melting temperature of 85° C.): 200 parts Cationic surfactant (SANISOL 850: manufactured by Kao Corporation): 10 parts Ion exchange water: 800 parts The above components are dispersed in a round stainless steel flask for 10 minutes using a homogenizer (ULTRA-TURRAX T50 manufactured by IKA, Ltd.), then is subjected to dispersion treatment by a pressure discharge-type homogenizer, and release agent particle dispersion (1) is prepared.

Preparation of Mixed Solution (1) of Styrene Resin Particle Dispersion and Release Agent Particle Dispersion Styrene resin particle dispersion (1): 800 parts Release agent particle dispersion (1): 900 parts In a state where 900 parts of the release agent particle dispersion (1) is heated and stirred at 60° C., 800 parts of the styrene resin particle dispersion (1) is added dropwise for 1 hour. After completing dropwise addition, the temperature is increased to 85° C. and stirring is continued for 30 minutes, and then the mixture is cooled to obtain a mixed solution (1) of the styrene resin particle and the release agent.

Preparation of Polyester Resin Particle Dispersion (1a)

An acid component formed of 80 mol % of terephthalic acid and 10 mol % of fumaric acid, an alcohol component formed of 45 mol % of bisphenol A ethylene oxide 2-mol adduct and 40 mol % of bisphenol A propylene oxide 2-mol adduct are set in a flask having an internal capacity of 5 L including a stirring device, a nitrogen introduction tube, and a temperature sensor, and a rectifier, a temperature thereof is increased to 80° C. for 2 hours in a nitrogen atmosphere and it is confirmed that the reaction system is evenly stirred. After that, 0.5 part of dibutyltin oxide is added with respect to 100 parts of the mixture, the temperature thereof is further increased to 210° C. from the temperature described above for 2 hours while distilling water generated, and dehydration condensation is further continued for 4 hours at 210° C. to obtain a polyester resin (1a).

Next, the obtained polyester resin (1a) is transported to CAVITRON CD1010 (manufactured by EUROTEC CO, Ltd.) at a rate of 100 g per minute in a melted state. Diluted ammonia water having a concentration of 0.37% obtained by diluting reagent ammonia water with the ion exchange water is put into an aqueous medium tank which is separately prepared, and is transported to CAVITRON CD1010 (manufactured by EUROTEC CO, Ltd.) at the same time as the melt of the polyester resin (1a) at a rate of 0.1 liter per minute while performing heating to 95° C. with a heat exchanger. CAVITRON is driven under conditions of a rotating speed of a rotor of 60 Hz and pressure of 5 kg/cm$^2$. After that, pH in the system is adjusted to 8.5 with 0.5 mol/L of sodium hydroxide aqueous solution and treatment is performed for 5 hours at 45° C., and then pH is adjusted to 7.5 with a nitric acid aqueous solution, and further, solid content is adjusted to obtain polyester resin particle dispersion (1a) in which, the polyester resin particle (1a) is dispersed.

Preparation of Polyester Resin Particle Dispersion (1b)

1,10-decanedicarboxylic acid: 33 parts 1,4-butanediol: 25 parts dimethyl sulfoxide: 30 parts ethylene glycol: 5 parts dibutyltin oxide: 0.5 part After putting the composition described above into a dried three-necked flask, the air in the container is set to be in an inert atmosphere with nitrogen gas by a depressurization operation, and the stirring is performed by mechanical stirring at 185° C. for 8 hours. After distilling dimethyl sulfoxide under the reduced pressure, the temperature is gradually increased to 210° C. under the reduced pressure and stirring is performed for 2 hours, and air cooling is performed and the reaction is stopped when the resultant material is in a viscous state, to synthesize the polyester resin (1b).

170 parts of the polyester resin (1b), 150 parts of ethyl acetate and 0.05 part of sodium hydroxide aqueous solution (0.5 N) are prepared, put in a separable flask of 500 mL, heated at 70° C., and stirred with Three-One Motor (manufactured by Shinto Scientific Co., Ltd.) to prepare a polyester resin mixed solution (1b). While stirring this polyester resin mixed solution (1b), 500 parts of sodium hydroxide aqueous solution (0.05 N) is slowly added thereto and phase-transfer emulsification is performed. The phase-transfer emulsified solution is put in a tray and continuously stirred for 48 hours in a well-ventilated place to be remove the solvent, and accordingly polyester resin, particle dispersion (1b) in which the polyester resin particle (1b) is dispersed is prepared.

Preparation of Colorant Dispersion (K)

Carbon black (MOGUL L: manufactured by Cabot Corporation): 55 parts

Nonionic surfactant (NONIPOL 400 manufactured by Sanyo Chemical Industries, Ltd.): 5 parts Ion exchange water: 220 parts The components described above are mixed with each other, stirred for 10 minutes using the homogenizes (ULTRA-TURRAX T50 manufactured by IKA, Ltd.), and then are subjected to dispersion treatment by an ultimizer to prepare a colorant dispersion (K) in which the colorant (carbon black) particle having an average particle diameter of 320 nm is dispersed.

Preparation of Toner Particle (1)

The polyester resin particle dispersion (1b) and the polyester resin particle dispersion (1a) are mixed with each other at a solid content rate of 15:70 to obtain mixed resin particle dispersion (1). 100 parts of the obtained mixed resin particle dispersion (1), 10 parts of the colorant dispersion (K), 10 parts of the release agent particle dispersion (1), 10 parts of the mixed solution (1) of styrene resin particle dispersion and release agent particle dispersion, 5 parts of poly aluminum hydroxide (Paho2S manufactured by Asada Chemical Industry Co., Ltd.), and 600 parts of the ion exchange water are mixed with each other and dispersed in a round stainless steel flask using the homogenizes (ULTRA-TURRAX T50 manufactured by IKA, Ltd.). After that, the resultant material is heated to 45° C. while stirring the content of the flask in a heating oil bath. After maintaining the resultant material at 45° C. for 30 minutes, the temperature is further increased and the resultant material is retained at 50° C. for 2 hours, to obtain dispersion containing aggregation particles. Then, after adding 20 parts of the polyester resin particle dispersion (1a) to the dispersion containing the obtained aggregation particle, the temperature of the heating oil bath is increased to 62° C. and retained for 30 minutes. In addition, after adding sodium hydroxide aqueous solution of 1N to adjust pH of the solution in the flask to 8.5, the stainless steel flask is tightly closed, the resultant material is heated to 85° C. while continuously being stirred using a magnetic seal and retained for 2 hours. After cooling with ice water, the toner particles in the flask are filtered with a mesh of 45 μm, cleaning is performed 5 times with 2500 parts of the ion exchange water at 25° C., and then freeze-drying is performed to obtain toner particles (1).

When the structure of the toner particle (1) is checked by the method described above, it is confirmed that the sea-island structure in which the polyester resin is set to the sea part and the vinyl resin is set to the island part is formed. In addition, when A1/B1 of the toner particles (1) is calculated by the method described above, the result is 0.56.

Preparation of Release Agent Particle Dispersion (2)

Release agent particle dispersion (2) is obtained in the same manner as the preparation of the release agent particle dispersion (1) except for using 10 parts of anionic surfactant (DOWFAX manufactured by Dow Chemical Company) instead of the cationic surfactant (SANISOL B50: manufactured by Kao Corporation).

Preparation of Mixed Solution (2) of Styrene Resin Particle Dispersion and Release Agent Particle Dispersion After mixing 900 parts of the release agent particle dispersion (2) and 600 parts of the styrene resin particle dispersion (1) with each other, 3 parts of poly aluminum hydroxide (Paho2S manufactured by Asada Chemical Industry Co., Ltd.) is added dropwise while mixing the material using the homogenizer (ULTRA-TURRAX T50 manufactured by IKA, Ltd.) in a round stainless steel flask, to obtain the mixed solution (2) of styrene resin particle dispersion and release agent particle dispersion.

Preparation of Toner Particles (2) to (10)

Toner particles (2) are obtained in the same manner as the preparation of the toner particles (1) except for using 20 parts of the mixed solution (2) of styrene resin particle dispersion and release agent particle dispersion, instead of 10 parts of the release agent particle dispersion (1) and 10 parts of the mixed solution (1) of styrene resin particle dispersion and release agent particle dispersion.

Toner particles (3) are obtained in the same manner as the preparation of the toner particles (1) except for using 6 parts of the release agent particle dispersion (1) and 17 parts of the mixed solution (1) of styrene resin particle dispersion and release agent particle dispersion, instead of 10 parts of the release agent particle dispersion (1) and 10 parts of the mixed solution (1) of styrene resin particle dispersion and release agent particle dispersion.

Toner particles (4) are obtained in the same manner as the preparation of the toner particles (1) except for using 4 parts of the release agent particle dispersion (1) and 23 parts of the mixed solution (1) of styrene resin particle dispersion and release agent particle dispersion, instead of 10 parts of the release agent particle dispersion (1) and 10 parts of the mixed solution (1) of styrene resin particle dispersion and release agent particle dispersion.

Toner particles (5) are obtained in the same manner as the preparation of the toner particles (1) except for changing the amount of the polyester resin particle dispersion (1a) to be added to the dispersion containing the aggregation particle, after obtaining the dispersion containing the aggregation particle by retaining for 2 hours at 50° C., to 5 parts.

Toner particles (6) are obtained in the same manner as the preparation of the toner particles (1) except for changing the resin dispersion to foe added to the dispersion containing the aggregation particle, after obtaining the dispersion containing the aggregation particle by retaining for 2 hours at 50° C., to 12 parts of the polyester resin particle dispersion (1a) and 10 parts of the styrene resin particle dispersion (1).

Toner particles (7) are obtained in the same manner as the preparation of the toner particles (1) except for using 17 parts of the release agent particle dispersion (1) and 7 parts of the mixed solution (1) of styrene resin particle dispersion and release agent particle dispersion, instead of 10 parts of the release agent particle dispersion (1) and 10 parts of the mixed solution (1) of styrene resin particle dispersion and release agent particle dispersion.

Toner particles (8) are obtained in the same manner as the preparation of the toner particles (1) except for using 18 parts of the release agent particle dispersion (1) and 4 parts of the mixed solution (1) of styrene resin particle dispersion and release agent particle dispersion, instead of 10 parts of the release agent particle dispersion (1) and 10 parts of the mixed solution (1) of styrene resin particle dispersion and release agent particle dispersion.

Toner particles (9) are obtained in the same manner as the preparation of the toner particles (1) except for using the mixed solution (2) of styrene resin particle dispersion and release agent particle dispersion, instead of the mixed solution (1) of styrene resin particle dispersion and release agent particle dispersion.

Toner particles (10) are obtained in the same manner as the preparation of the toner particles (1) except for changing the resin dispersion to be added to the dispersion containing the aggregation particle, after obtaining the dispersion containing the aggregation particle by retaining for 2 hours at 50° C., to 25 parts of the styrene resin particle dispersion (1).

Preparation of Toner Particles (11)

Styrene acrylic resin (molecular weight Mw of 20000, glass transition temperature of 80° C.): 100 parts Paraffin Wax (HNP0190): 50 parts After premixing the above materials, the materials are kneaded using a Banbury mixer 90 rpm, ram pressure of 4 kgf, kneading time of 20 minutes), rolled, cooled, and crushed using a Fitzmill to obtain a mixture (1) of styrene acrylic resin and paraffin wax.

Mixture (1) of styrene acrylic resin and paraffin wax: 20 parts

Paraffin wax (HNP0190): 3 parts

Polyester resin (1a): 70 parts

Polyester resin (1b): 15 parts

Carbon black (MOGUL L): 5 parts

After premixing the above materials, the materials are kneaded with an extruder mixer (a barrel temperature is set to 105° C. while adding 2 parts of water with respect to 100 parts of the materials), rolled, cooled, and then crushed using the Fitzmill, and pulverized using 100 AFG (pulverization pressure of 0.4 MPa, pulverization nozzle diameter ϕ of 2 mm), to obtain coloring particles (1) having an average particle diameter of 8.5 μm using an elbow-jet classifier. 100 parts of the coloring particles (1), 10 parts of the cationic surfactant (SANISOL B50), and 1000 parts of the ion exchange water are stirred and mixed with each other to obtain coloring particle dispersion (1).

After mixing 15 parts of the polyester resin dispersion (1a) and 2 parts of poly aluminum hydroxide (Paho2S) into 100 parts of the coloring particle dispersion (1) using the homogenizer (ULTRA-TURRAX T50), the mixture is put in a closed reaction container including a semi-circular shaped stirring blade, is mixed at 50° C. for 2 hours while stirring, and then the temperature is increased to 80° C. and the stirring is continued for 2 hours. After cooling with ice water, the coloring particles in the closed reaction container are filtered with the mesh of 45 μm, cleaning is performed 5 times with 2500 parts of the ion exchange water at 25° C., and then freeze drying is performed to obtain toner particles (11).

Preparation of Toner Particles (R1) to (R4)

Toner particles (R1) are obtained in the same manner as the preparation of the toner particles (1) except for using 25 parts of the mixed solution (1) of styrene resin particle dispersion and release agent particle dispersion, instead of the release agent particle dispersion (1) and 10 parts of the mixed solution (1) of styrene resin particle dispersion and release agent particle dispersion.

Toner particles (R2) are obtained in the same manner as the preparation of the toner particles (1) except for using 20 parts of the release agent particle dispersion (1), instead of the release agent particle dispersion (1) and the mixed solution (1) of styrene resin particle dispersion and release agent particle dispersion.

Toner particles (R3) are obtained in the same manner as the preparation of the toner particles (1) except tor using 20 parts of the release agent particle dispersion (1) and 2 parts of the mixed solution (1) of styrene resin particle dispersion and release agent particle dispersion.

Toner particles (R4) are obtained in the same manner as the preparation of the toner particles (1) except for using 2 parts of the release agent particle dispersion (1) and 25 parts of the mixed solution (1) of styrene resin particle dispersion and release agent particle dispersion.

Example 1

Toner particles (1); 100 parts

Hydrophobic silica (RX50 manufactured by Nippon Aerosil Co., Ltd.): 0.5 part

Hydrophobic silica (R972 manufactured by Nippon Aerosil Co., Ltd.): 1.5 parts

After blending the components described above at a peripheral speed of 20 m/s for 15 minutes using a Henschel mixer, coarse particles are removed using a sieve with a mesh of 45 μm to obtain toner (1).

Examples 2 to 11 and Comparative Examples 1 to 4

Each of toners (2) to (11) and (R1) so (R4) is prepared in the same manner as the preparation of the toner (1) except for changing the toner particles (1) to each of toner particles (2) to (11) and (R1) to (R4).

Preparation of Electrostatic Charge Image Developer

Preparation of Carrier 2.5 parts of a styrene-acrylic resin (styrene: methyl methacrylate=10:90, Mw: 35000) is put into 45 parts of toluene to prepare a resin solution. 0.2 part of carbon black is put into the resin solution and the mixed solution is subjected to minute dispersion using a sand mill for 30 minutes to prepare dispersion. 25 parts of the dispersion is mixed with 100 parts of ferrite particles having a volume average particle diameter of 30 μm. Further, the mixture is put in a vacuum deaeration type kneader, stirred for 30 minutes while heating to 80° C., and further stirred while reducing pressure to remove the solvent. After removing the solvent, sieving is performed with a mesh of 75 μm, and the aggregated material is removed to obtain a carrier.

Preparation of Electrostatic Charge Image Developer 10 parts of each of the obtained toners and 90 parts of the carrier are stirred using a V-blender at 20 rpm for 20 minutes, and sieved with a sieve having a mesh of 212 μm to obtain electrostatic charge image developers (hereinafter, referred to as "developers") (1) to (11) and (R1) to (R4).

Offset

The electrostatic charge image developers obtained in respective examples are filled in a developing device of a commercially available electrophotographic copying machine (DocuCentre Color 450 (manufactured by Fuji Xerox Co., Ltd.) remodeled), an unfixed image having image density of 50% and a size of 3×3 cm is output to a position 1 cm from an upper edge of PREMIER 80 A4 WHITE PAPER (manufactured by Xerox Corporation, basis weight of 80 $g/m^2$) in a state where a toner amount is adjusted to 5 $g/m^2$ when the image density is 100%.

Next, a fixing device used in DocuCentre Color 450 is extracted, and using a remodeled device which can perform external driving and temperature control, an unfixed image is fixed under driving conditions of a fixing member surface temperature at the time of paper Introduction of 200° C. and a fixing speed of 50 mm/sec. A blank portion on the lower side of the fixed image is observed and occurrence of toner staining (toner offset) is checked visually and with a 50× magnifier.

The evaluation criteria are as follows.

A: no staining due to toner offset is observed.

B: staining due to toner offset is not visually observed but extremely slight staining is observed in magnifier observation.

C: extremely slight staining due to toner offset is visually observed.

B: noticeable staining due to toner offset is visually observed.

Image Intensity

The electrostatic charge image developers obtained in each example fill a developing device of a commercially available electrophotographic copying machine (DocuCentre Color 450 (manufactured by Fuji Xerox Co., Ltd.) remodeled), and an unfixed image having a size of 3×3 cm which is a half tone image having image density of 20% is output to a position 3 cm from an upper edge of PREMIER 30 A4 WAITE PAPER (manufactured by Xerox Corporation, basis weight of 80 $g/m^2$).

Next, a fixing device used in DocuCentre Color 450 is extracted, and using a remodeled device which can perform external driving and temperature control, an unfixed image is fixed under driving conditions of a fixing member surface temperature at the time of paper introduction of 140° C. and a fixing speed of 200 mm/sec. Using a surface property tester Tribogear 14DR (manufactured by Shinto Scientific Co., Ltd.), an unused sheet of PREMIER80 is loaded on the image and the fixed image surface is rubbed with a vertical lead of 100 g, at a rubbing speed of 10 mm/sec, a rubbing reciprocating width of 5 cm, and 10 times of rubbing reciprocating, and then the staining on the unused sheet is observed visually and with a 50× magnifier. The evaluation criteria are as follows.

A: no staining due to toner is observed.

B: staining due to toner is not visually observed but extremely slight staining is observed in magnifier observation.

C: extremely slight staining due to toner is visually observed.

D: noticeable staining due to toner is visually observed.

Image Unevenness

The electrostatic charge image developers obtained in each example fill a developing device of the image forming apparatus manufactured by Fuji Xerox Co., Ltd. "remodeled DocuCentre Color 450".

Using this image forming apparatus, an unfixed image having a size of 10×10 cm which is a half tone image having image density of 35% is output to a position 3 cm from an upper portion of A4 sheet of PREMIER 80 A4 WHITE PAPER (manufactured by Xerox Corporation, basis weight of 80 g/m$^2$).

Next, a fixing device used in DocuCentre Color 450 is extracted, and using a remodeled device which can perform external driving and temperature control, an unfixed image is fixed under driving conditions of a fixing member surface temperature at the time of paper introduction of 160° C. and a fixing speed of 300 mm/sec.

After that, visual observation of the fixed half tone image is performed, and evenness and a degree Of unevenness of the half tone image are evaluated.

The evaluation criteria are as follows.

A: no density unevenness of the half tone image is observed.

B: slight density unevenness of the half tone image is observed on a part of the image.

C: density unevenness of the half tone image is observed over almost the entire surface.

Hereinafter, details of each example and the evaluation results are shown in Table 1.

From the above results, it is found that, even when a half tone image is formed on a recording medium having great concavity and convexity, the image intensity of the half tone image is improved and the occurrence of offset is suppressed in the examples, compared to in the comparative examples. The excellent results in the offset and the image intensity are obtained with the melt toner particles.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing:

a binder resin containing a polyester resin forming a sea part of a sea-island structure and a surface layer of the toner particles, and a vinyl resin forming an island part of the sea-island structure, a first release agent existing in the sea part in a domain state, and a second release agent existing in the island part in a domain state, wherein:

when a cross-sectional area of the second release agent is set to A1 and a cross-sectional area of the first release agent is set to B1 in a cross section of the toner particles, a relationship of $0.2 \leq A1/B1 \leq 0.8$ is satisfied, and the first release agent and the second release agent are each paraffin wax.

2. The electrostatic charge image developing toner according to claim 1, wherein 60% or more of the polyester resin exists in the surface layer of the toner particles.

TABLE 1

| | Toner | Developer | Ratio of cross-sectional area A1/B1 | Sea-island structure | Ratio of polyester resin existing on surface of toner particles [%] | Evaluation: Unevenness of image | Evaluation: Offset | Evaluation: Image intensity |
|---|---|---|---|---|---|---|---|---|
| Example 1 | Toner 1 | Developer 1 | 0.56 | Formed | 95 | A | A | A |
| Example 2 | Toner 2 | Developer 2 | 0.45 | Formed | 96 | A | A | A |
| Example 3 | Toner 3 | Developer 3 | 0.68 | Formed | 90 | A | B | A |
| Example 4 | Toner 4 | Developer 4 | 0.77 | Formed | 92 | A | C | A |
| Example 5 | Toner 5 | Developer 5 | 0.55 | Formed | 60 | B | A | A |
| Example 6 | Toner 6 | Developer 6 | 0.43 | Formed | 55 | C | A | A |
| Example 7 | Toner 7 | Developer 7 | 0.35 | Formed | 85 | A | A | B |
| Example 8 | Toner 8 | Developer 8 | 0.22 | Formed | 84 | A | A | C |
| Example 9 | Toner 9 | Developer 9 | 0.59 | Formed | 89 | A | A | A |
| Example 10 | Toner 10 | Developer 10 | 0.44 | Formed | 25 | C | A | A |
| Example 11 | Toner 11 | Developer 11 | 0.49 | Formed | 82 | A | A | A |
| Com. Ex. 1 | Toner R1 | Developer R1 | 0.00 | Not formed | 95 | A | A | D |
| Com. Ex. 2 | Toner R2 | Developer R2 | 1.00 | Not formed | 98 | A | D | A |
| Com. Ex. 3 | Toner R3 | Developer R3 | 0.12 | Formed | 83 | A | A | D |
| Com. Ex. 4 | Toner R4 | Developer R4 | 0.84 | Formed | 88 | A | D | A |

3. The electrostatic charge image developing toner according to claim 1, wherein a glass transition temperature (Tg) of the polyester resin is from 50° C. to 80° C.

4. The electrostatic charge image developing toner according to claim 1, wherein a weight average molecular weight (Mw) of the polyester resin is from 5,000 to 1,000,000.

5. The electrostatic charge image developing toner according to claim 1, wherein a number average molecular weight (Mn) of the polyester resin is from 2,000 to 100,000.

6. The electrostatic charge image developing toner according to claim 1, wherein a molecular weight distribution Mw/Mn of the polyester resin is from 1.5 to 100.

7. The electrostatic charge image developing toner according to claim 1, further comprising fumaric acid as an acid component constituting the polyester resin.

8. The electrostatic charge image developing toner according to claim 1, further comprising acrylic acid as a monomer constituting the vinyl resin.

9. The electrostatic charge image developing toner according to claim 1, wherein a content of the binder resin is from 40% by weight to 95% by based on the total amount of the toner particles.

10. The electrostatic charge image developing toner according to claim 1, wherein a mass ratio of the polyester resin to the vinyl resin (polyester resin: vinyl resin) is from 98:2 to 60:40.

11. The electrostatic charge image developing toner according to claim 1, wherein the first release agent the second release agent each have a melting temperature of from 50° C. to 110° C.

12. The electrostatic charge image developing toner according to claim 11, wherein a total content of the first release agent and release agent is from 1% by weight to 20% by weight based on the total amount of the toner particles.

13. The electrostatic charge image developing toner according to claim 1, wherein a volume particle diameter (D50v) of the toner particles is from 2 μm to 10 μm.

14. The electrostatic charge image developing toner according to claim 1, wherein a shape factor SF1 of the toner particles is from 110 to 150.

15. An electrostatic charge image developer comprising the electrostatic charge image developing toner according to claim 1.

16. The electrostatic charge image developer according to claim 15, wherein the electrostatic charge image developer contains a resin-coated carrier.

17. The electrostatic charge image developer according to claim 16, wherein a resin of the resin-coated carrier is styrene acrylic resin.

18. A toner cartridge that accommodates the electrostatic charge image developing toner according to claim 1, and is detachable from an image forming apparatus.

19. The electrostatic charge image developing toner according to claim 1, wherein the vinyl resin is homopolymer or a copolymer of one or more monomers selected from the group consisting of (meth)acrylic ester compounds, ethylenic unsaturated nitrile compounds, and vinyl ether compounds.

* * * * *